US008791351B2

(12) United States Patent
Kinman

(10) Patent No.: US 8,791,351 B2
(45) Date of Patent: Jul. 29, 2014

(54) MAGNETIC FLUX CONCENTRATOR FOR INCREASING THE EFFICIENCY OF AN ELECTROMAGNETIC PICKUP

(76) Inventor: Christopher Kinman, Auchenflower (AU)

( * ) Notice: Subject to any disclaimer, the term of this patent is extended or adjusted under 35 U.S.C. 154(b) by 0 days.

(21) Appl. No.: 13/282,447

(22) Filed: Oct. 26, 2011

(65) Prior Publication Data

US 2012/0103170 A1 May 3, 2012

Related U.S. Application Data

(60) Provisional application No. 61/407,149, filed on Oct. 27, 2010.

(51) Int. Cl.
*G10H 3/00* (2006.01)

(52) U.S. Cl.
USPC ..... 84/723; 84/725; 84/726

(58) Field of Classification Search
None
See application file for complete search history.

(56) References Cited

U.S. PATENT DOCUMENTS

| | | | | | |
|---|---|---|---|---|---|
| 4,372,186 | A * | 2/1983 | Aaroe | ..... | 84/725 |
| 5,525,750 | A * | 6/1996 | Beller | ..... | 84/726 |
| 5,592,037 | A * | 1/1997 | Sickafus | ..... | 310/40 MM |
| 5,646,464 | A * | 7/1997 | Sickafus | ..... | 310/40 MM |
| 7,135,638 | B2 * | 11/2006 | Garrett et al. | ..... | 84/725 |
| 7,166,793 | B2 * | 1/2007 | Beller | ..... | 84/723 |
| 7,227,076 | B2 * | 6/2007 | Stich | ..... | 84/726 |
| 7,994,413 | B2 * | 8/2011 | Salo | ..... | 84/726 |
| 2006/0156911 | A1 * | 7/2006 | Stich | ..... | 84/726 |
| 2010/0122623 | A1 * | 5/2010 | Salo | ..... | 84/726 |
| 2012/0103170 | A1 * | 5/2012 | Kinman | ..... | 84/726 |

* cited by examiner

*Primary Examiner* — Marlon Fletcher
(74) *Attorney, Agent, or Firm* — Thompson Hine LLP

(57) ABSTRACT

An electromagnetic pickup adapted to be secured to a stringed musical instrument, such as a guitar or bass or the like, of the type having a plurality of magnetic strings of ferromagnetic composition such as steel tensioned to provide musical notes under mechanical stimulation such as picking is disclosed. The electromagnetic pickup comprises at least one magnetized core having a length and a width. An electrically conductive material is wound into at least one coil around the magnetized core, and a ferromagnetic material such as iron, nickel, cobalt or alloys thereof is positioned on at least one side of the length and internally of at least a portion of the electrically conductive material. The electromagnetic pickup is mounted proximate the strings in such a manner that magnetic field of the pickup extends to the strings for the purpose of generating an output electrical signal analogous to the musical notes.

13 Claims, 4 Drawing Sheets

MAGNETIC FLUX CONCENTRATOR FOR INCREASING THE EFFICIENCY OF AN ELECTROMAGNETIC PICKUP

CROSS REFERENCE TO RELATED APPLICATIONS

This application claims the benefit of U.S. Provisional Patent Application No. 61/407,149, filed Oct. 27, 2010, the disclosure of which is hereby incorporated herein by reference thereto.

TECHNICAL FIELD

The present invention relates to electromagnetic pickups for amplified stringed musical instruments such as a guitar and, more particularly, to an electromagnetic pickup having a magnetic field which is significantly more concentrated internally than those of existing magnetic pickups for the purpose of improved efficiencies.

STATEMENT REGARDING FEDERALLY SPONSORED RESEARCH OR DEVELOPMENT (Not applicable)

BACKGROUND OF THE INVENTION

Electromagnetic pickups are used in amplified stringed musical instruments, one example being electric guitars, for the purpose of deriving an electrical signal from vibration of the guitar's strings. This electrical signal is fed to an amplifier and subsequently to a loudspeaker system for conversion to audible sound, thus amplifying the faint sound of the guitars strings into a much louder sound. The aforementioned guitars typically comprise an instrument body having a top face, a neck secured at one end to the instrument body and extending from the instrument body, a number of strings tensioned between anchor points mounted on the neck and a bridge mounted on the top face of the instrument body, and an electromagnetic pickup secured to the top face of the instrument body and positioned close to the string.

One means by which the above electrical signal is derived is an electromagnetic system, comprising, for example, one or more permanent magnets in the core of a coil to provide a magnetic field which encompasses the pickup's sensing coil assembly and extends to the magnetically attractive (for example, ferromagnetic) strings of the instrument.

Another means for generating an electrical signal is one or more coil core pieces made of ferromagnetic material which is not a permanent magnet, but having a separate attendant means of magnetization such as a permanent magnet. The magnetized core pieces attract and channel the magnetic field emanating from the permanent magnet, and divert shape that magnetic field to encompass the pickup sensing coil assembly and to extend to the strings of the instrument. The strings of the instrument are of magnetic steel and attract and vary the magnetic field in response to the vibrations or oscillations of the strings. By the well known electric current generation effect discovered by Michael Faraday in year 1831 this causes any coil of electrically conductive wire that is present in the magnetic field to output electrical signals corresponding and analogous to the strings' vibrations. These electrical signals are then sent to an amplifier and loudspeaker system for reproduction into audible sounds.

Thus, it will be understood that electromagnetic pickups, also known as transducers or sensors pertaining to stringed musical instruments convert mechanical energy of vibrating strings into corresponding electrical energy. As with any electrical generation device guitar transducers have various degrees of efficiency in transducing mechanical energy to electrical energy. There exists certain circumstances that require a high degree of transduction efficiency and there have been various inventions and means to accomplish this. However as electromagnetic pickup technology advances an even greater degree of efficiency is demanded.

One means of increasing efficiency of an electromagnetic pickup is to wind more turns onto the coil, this is known as over-winding. Since only a relatively small electric current is induced into each turn or loop of the coil and the electrical currents are added to each other in a multi-turn coil, it follows that the more turns or loops in the coil the greater the accumulated output is from the coil. Since the number of turns correlates to the electrical output signal, a greater output is derived from adding more turns. In practice, adding more turns also increases the interlayer capacitance effect within the coil and causes sonic degradation by lessening the harmonic content of the signal resulting in loss of clarity and definition.

Another common practice among pickup designers used to increase efficiency of an electromagnetic pickup is to utilize stronger and/or larger magnets than normal, often in conjunction with over-winding the coils. However, excessive magnetism interferes with the vibration pattern of instrument strings causing aberration of musical pitch and results in unmusical discordant frequencies to be present. Excessive magnetism also shortens sustain of string vibrations by attracting the strings into a downward U shaped oscillation path thereby causing strings to collide into the frets of the instrument thereby robbing the strings of energy and causing a corresponding buzzing sound in the signal. This is highly unsatisfactory since musicality of the instrument is severely compromised.

A further means with no attendant sonic degradation of increasing efficiency of an electromagnetic pickup is to dispose the pickup coil assembly into a U shaped channel comprised of a ferromagnetic material such as steel. The magnetic channel attracts and captures magnetic energy that normally radiates far beyond the confines of the pickup and diverts this energy into a semi closed loop from one magnetic pole positioned at the bottom of the coil to the opposite magnetic pole positioned at the top of the coil. The poles being represented at the ends of the permanent magnet in the core of, and perpendicular to the axis of the coil. The open portion of the semi closed loop encompasses the magnetic strings of the guitar thus allowing the magnetic field to grasp the strings, flow through a portion of the strings and return to the opposite end of the permanent magnet. Thus the strings are coupled to a greater degree to the magnetic circuit of the pickup for the purpose of efficiently transducing their mechanical energy to electrical energy.

It is a primary objective of the current invention, a magnetic flux concentrator device, to provide an improved means of increasing the electromagnetic efficiency whereby string vibrations are converted to electrical signals.

SUMMARY OF THE INVENTION

The inventive magnetic flux concentrator device may be comprised of one or more metal strips of magnetic material or magnetic wire, for example fine steel wire, disposed within the sensing coil. The inclusion of a magnetic material within the sensing coil attracts and concentrates a substantially greater amount of available magnetic energy into the coil space as compared to prior art designs. By attracting available magnetic energy from the ends of the magnetized coil core, which, in one embodiment, it surrounds, the inventive magnetic flux concentrator device tends to have the effect of reducing the magnetic energy available to the strings at the ends of the magnetized core. This may be thought of as short circuiting available magnetic energy.

Since magnetism is the primary driver of electromotive force in coils designed to output an electrical current, it has hitherto been considered desirable to apply as much magnetic energy to the strings of the instrument and sensing coil as other considerations will allow in order to obtain an acceptable efficiency. Thus, the notion of incorporating a device that reduces the strength or concentration of the magnetic field emanating from a pickup hitherto might have been dismissed as self defeating and has not previously been practiced in the art.

The inventive magnetic flux concentrator device within the sensing coil attracts and concentrates more of the available magnetic energy emanating from the source of the magnetic field that is associated with the sensing coil directly into the sensing coil space where it is transduced into electrical signal with a substantially greater degree of efficiency than prior art without increasing the number of turns in the sensing coil or resorting to larger or more powerful magnets.

The apparent reduction of magnetic strength at the ends of the coil core is one aspect of the invention that is not present with other methods and is highly beneficial since, as pointed out in previous paragraphs the instrument strings exhibit undesirable behavior when subjected to a strong and concentrated magnetic force and thus the utilization of the invention results in high purity sound that is devoid of buzzing and aberration of musical pitch.

Embodiments of the invention have the advantage of achieving highly efficient signal generation from pickups for stringed musical instrument that does not result in sonic degradation since very high efficiency can be derived from sonically optimized coils. Additionally the stability and purity of musical pitch of the instrument strings are not compromised by excessive magnetic interference since the resultant weakened magnetic do not interfere with vibration patterns of the strings.

The inventive magnetic flux concentrator device may be used in any kind of electromagnetic instrument pickup where a greater efficiency of transduction is required. This includes pickups that have magnetic U channel, so called flux transfer plates, any number of coils, any kind of permanent magnet (be it a bar magnet or rod magnet or another kind of magnet) and any kind of coil core such as a single steel bar or multiple steel strips, steel rods, adjustable steel screws, permanent magnets and so on. Some such pickups are commonly known as single coils with rod magnets, single coils with bar magnets such as the P-90, side-by-side humbucking and vertical hum-canceling pickups.

The inventive magnetic flux concentrator device when comprised of magnetic wire is less complicated and cheaper to manufacture because it requires none of the expensive tooling and finishing pertaining to solid metal parts.

The effect of attracting and concentrating the available magnetic energy into the coil space is also present when the invention is executed in the form of steel wire wound either as a full coil or wound as an additional or separate coil within another coil comprised of copper wire. Steel wire may also be integrated and dispersed within a copper coil as referred to in the description of the FIG. 4 embodiment, below. The steel wire may not be or may be electrically connected to the copper coil and incorporated into the electrical signal circuit to achieve desired sonic effects.

The inventive magnetic flux concentrator device may also be comprised of a strip of thin steel sheet wrapped around the core of the pickup coil as depicted in the various drawings. However, like efficiency is achieved with one or more flat strips of steel abutting the side or sides of the coil core and not wrapped around the magnets.

The inventive magnetic flux concentrator device may also be comprised of one or more flat magnetic members that, acting as flanges forming a coil space, divide the main coil space into two or more separate coaxial coil spaces. Typically, these members may be sheet steel of suitable shape and size secured to the core or they may be steel wire wound in a suitable manner onto the core. Disposed perpendicular to previously described embodiments, such dividers have the same effect of attracting and concentrating available magnetic energy into the coil spaces.

Steel is convenient to fashion the strip from because of its malleability and ease of cutting, which lends to forming a suitable shape for the purpose. However, any magnetic material can be used and is not limited to steel. It can also be arranged in the form of a sleeve which surrounds each individual core piece or any combination of the aforementioned.

In accordance with the invention, an electromagnetic pickup is adapted to be secured to a stringed musical instrument, such as a guitar or bass or the like, of the type having a plurality of magnetic strings of ferromagnetic composition such as steel tensioned to provide musical notes under mechanical stimulation such as picking. The electromagnetic pickup comprises at least one magnetized core having a length and a width. An electrically conductive material is wound into at least one coil around the magnetized core, and a ferromagnetic material such as iron, nickel, cobalt or alloys thereof is positioned on at least one side of the length and internally of at least a portion of the electrically conductive material. The electromagnetic pickup is mounted proximate the strings in such a manner that magnetic field of the pickup extends to the strings for the purpose of generating an output electrical signal analogous to the musical notes.

The electrically conductive material may comprise insulated copper wire and the ferromagnetic material may comprise at least one ferromagnetic member having a length and a width and a thickness much smaller than the length and width.

The ferromagnetic material comprises ferromagnetic wire. The magnetized core may comprise at least one permanent magnet. The magnetized core comprises at least one ferromagnetic member that is not a permanent magnet and an associated permanent magnet is disposed adjacent to the ferromagnetic member. The ferromagnetic material may comprise steel wire, the steel wire being wound concurrently with the copper wire resulting in a coil of copper and steel dispersed within the coil. The ferromagnetic material may comprise at least one strip of ferromagnetic material having a length and a width and a thickness much smaller than the length and width, the strip being placed parallel to the coil axis and co-planar with windings of the coil. The electrically conductive material may comprise an insulated copper wire coil and the ferromagnetic material may comprise a coil of ferromagnetic wire having a length and a width and a thickness much smaller than the length and width, the coil of ferromagnetic wire being wound co-planar and co-axial with windings of the copper wire coil.

The inventive coil may be positioned within or on a stringed amplified musical instrument that is remote from but which is connected electrically to at least one string sensing coil and functioning as a hum sensor, the hum sensor being wound with ferromagnetic wire for the purpose of canceling extraneous radiated hum generated by mains powered appliances and wiring from the string sensing coil.

Generally, in accordance with the invention, a pickup coil may comprise a ferromagnetic wire positioned, configured and dimensioned with respect to a magnetic core producing a magnetic field to improve the efficiency of the signal generating capability of the pickup.

BRIEF DESCRIPTION THE DRAWINGS

The operation of the invention will become apparent from the following description taken in conjunction with the drawings, in which:

FIG. 1 shows a simplified electro magnetic guitar pickup known as a single coil. Six permanent rod magnets are secured between two flanges to form a bobbin with a coil space. The coil is wound between the flanges and over and around the six rod magnets. The magnetic field emanating from the ends of rod magnets extends far beyond the confines of the bobbin.

Figure 7:
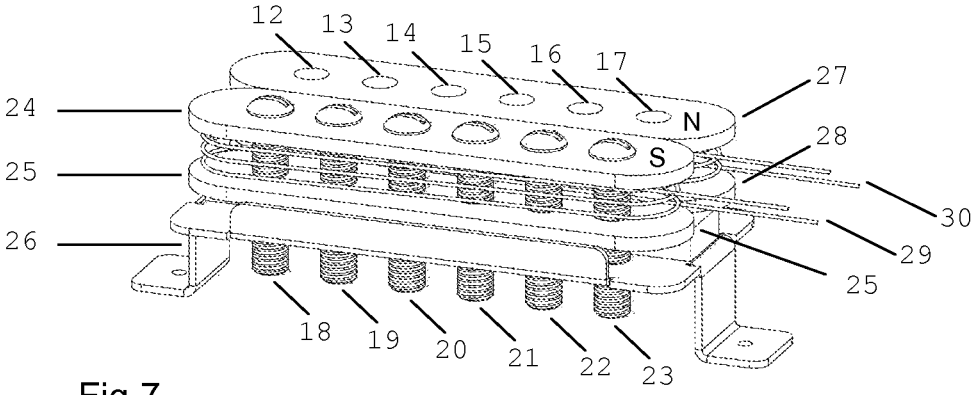

FIG. 7 shows an electromagnetic pickup known as a side-by-side humbucking pickup. There are two bobbins and two coils. The coils are electrically connected and arranged in a manner that cancels electromagnetically radiated 60 Hz mains hum whilst the string signal is not canceled but rather added together effectively doubling the output of each coil.

Figure 8:
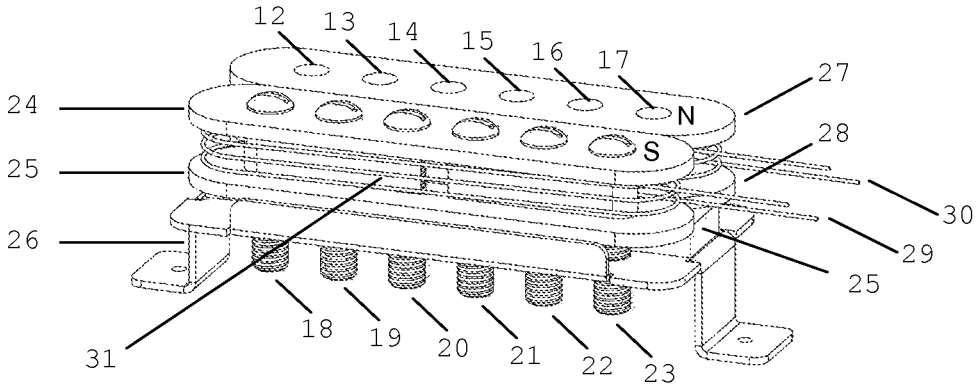

FIG. 8 shows the same pickup as FIG. 7 with the addition of the inventive magnetic flux concentrator device. The magnetic flux concentrator device is magnetic and therefore attracts the magnetic energy emanating from the ends of the magnetically charged poles and concentrates it into the coil space.

DETAILED DESCRIPTION OF THE PREFERRED EMBODIMENTS

Essentially all electromagnetic pickups have a ferromagnetic core associated with a coil of insulated copper wire. The core may be permanent rod magnets, iron rods in the form of adjustable steel screws, non-adjustable iron rods, a combination of both steel screws and iron rods, or a singular iron bar known as a blade or rail.

Figure 1:
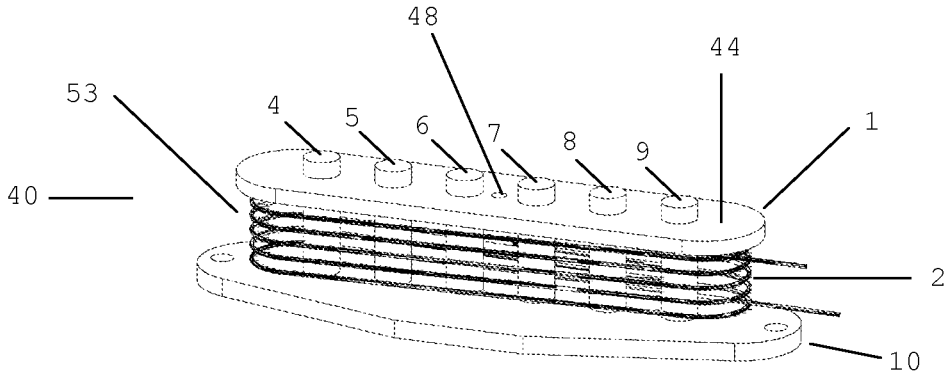
Figure 2:
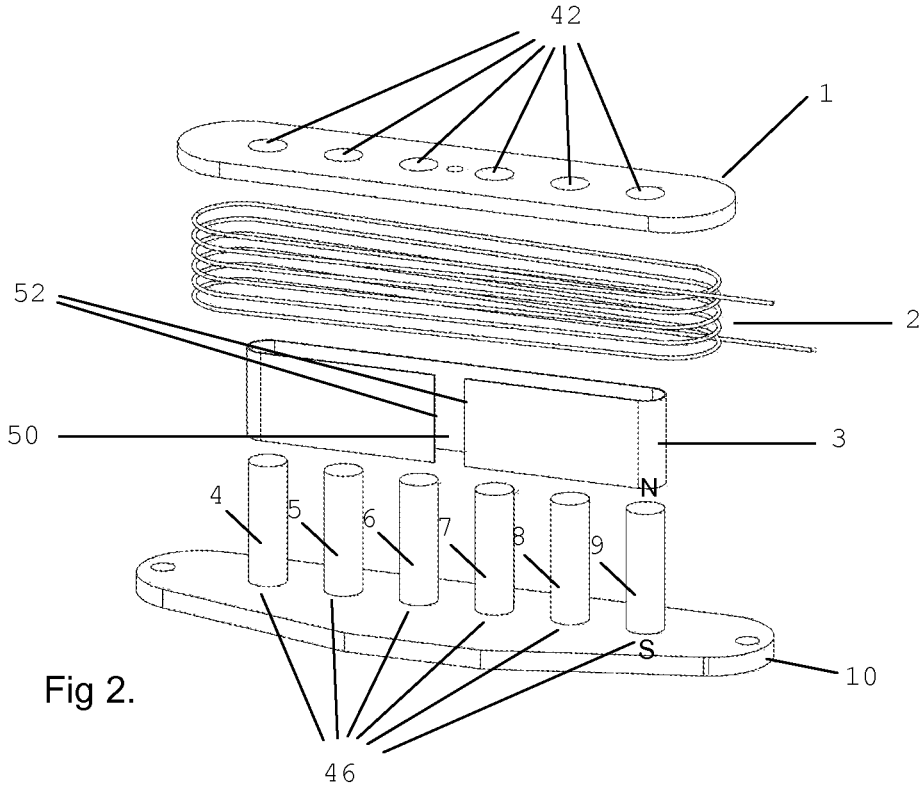
FIG. 2 and FIG. 3 show the same pickup as FIG. 1 exploded and not exploded with the addition of the inventive magnetic flux concentrator device. The magnetic flux concentrator device is magnetic and therefore attracts the magnetic energy emanating from the ends of the magnets and concentrates it into the coil space.
Figure 3:
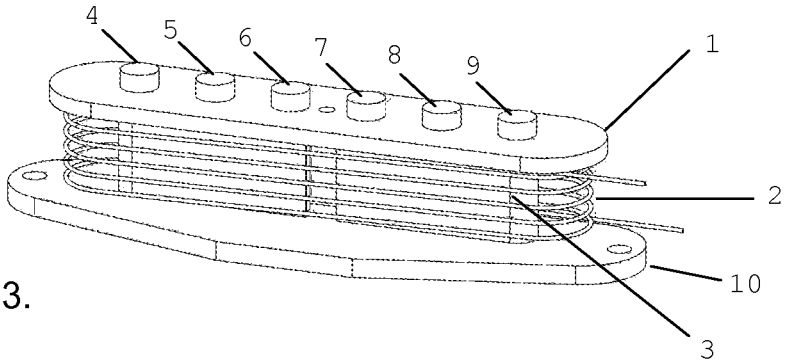

One embodiment of a pickup incorporating the inventive magnetic flux concentrator device, which is shown in FIGS. 1, 2 and 3, uses a plurality of Alnico rod magnets 4, 5, 6, 7, 8, and 9 to form a core. A coil 2 is wound around Alnico rod magnets 4, 5, 6, 7, 8, and 9. Coil 2 is comprised of many turns of insulated copper wire, for example, 8000 turns of 42 gauge varnished or otherwise insulated copper wire or the equivalent. Rod magnets 4-9 have a diameter of 4.8 mm and a length of 17 mm, and have been permanently magnetized to a degree typical of rod magnets in guitar pickups. Rod magnets 4, 5, 6, 7, 8, and 9 may be obtained from AZ Industries, Inc. of Highland, Ark., USA. Rod magnets 4-9 are magnetized vertically, that is to say that one of their ends is a magnetic north pole and the other end is a magnetic south pole. All of the rod magnets 4-9 are typically oriented with their north poles extending in the same direction. However in some designs the orientation of some magnets may be opposed, for example three magnets have their north pole up and another 3 magnets have their south pole up.

FIGS. 1 and 2 depict a typical single coil pickup 40 comprising an upper bobbin flange 1, which includes a plurality of holes 42. Holes 42 are dimensioned to receive and frictionally retain rod magnets 4, 5, 6, 7, 8, and 9. Upper bobbin flange 1 has a length of 72.5 mm and a width of 15.6 mm. Rod magnets 4, 5, 6, 7, 8, and 9 extend 2 mm beyond the top surface 44 of upper bobbin flange 1. A corresponding lower flange 10, which has a length of 84 mm and a width of 23 mm, also defines a plurality of holes 46, which receive the lower ends of rod magnets 4, 5, 6, 7, 8, and 9. Rod magnets 4, 5, 6, 7, 8, and 9 are positioned in holes 46 with a center to center spacing of 10.5 mm. Holes 46 are dimensioned to receive and frictionally retain rod magnets 4, 5, 6, 7, 8, and 9. Alnico rod magnets 4-9 supported and secured by flanges 1 and 10 form a coil space 53 with a core, around which core is wound a coil 2 comprised of many turns of insulated copper wire. A central hole 48 performs the function of receiving a fastener to secure the bobbin to a coil winding machine. Hole 48 is typically dimensioned to a 2.5 mm diameter.

As shown in FIG. 2, a magnetic flux concentrator device 3 comprised of a thin strip of magnetic (for example, ferromagnetic) sheet metal is disposed around rod magnets 4, 5, 6, 7, 8, and 9. A suitable material for magnetic flux concentrator device 3, whose function is detailed below, may comprise sheet steel. The magnetic flux concentrator device 3 is not shown in FIG. 1 for purposes of clarity of illustration. However, referring to FIGS. 2-3, magnetic flux concentrator device 3 may be made of sheet steel having a thickness of 0.5 mm, a length of 120 mm and a width of 12 mm. This results in a minimal gap 50 between the ends 52 of, for example, 1.5 mm.

The magnetic flux concentrator device 3 may also be made of a series (or matrix e.g. a 3 by 36 matrix) of square or rectangular ferromagnetic sheet members electrically insulated from each other, but carried on a common thin substrate. For example, for the purpose of reducing eddy currents, the core strip can comprise a strip of mylar plastic with a length of 120 mm and a width of 12 mm, and have ninety 3.8 mm by 3.8 mm patches of ferromagnetic material secured to it in an array which is three patches wide and thirty patches long. Alternatively, those patches that would overlie the ends of the length of the core may be omitted from the ends of the pickup to further concentrate the magnetic flux and enhance pickup performance.

As shown in FIGS. 2 and 3, a magnetic flux concentrator device 3 comprised of a thin strip of magnetic sheet metal is disposed around an array of rod-like magnets. A coil of insulated copper wire 2 is wound over the magnetic flux concentrator device and rod magnets and is connected to an amplifier and loudspeakers. Magnetic flux concentrator device 3 of magnetic material abutting the sides of the core formed by magnets 4-9 increases the efficiency of the pickup coil by attracting, focusing and concentrating available magnetic energy into the space occupied by the coil. This increases the inductance of the coil with consequent substantial increase in efficiency. Importantly, this increase in efficiency does not require an increase in the number of turns of the coil or magnetic parameters and so there is none of the sonic and playability degradation caused by over-winding with smaller wire and using excessively strong magnets. At the same time, because fewer turns of larger gauge wire is used to form the coil, capacitance (and the effect of capacitance to degrade performance) is reduced.

This magnetic flux concentrator device 3 has an entirely different function as compared to that of a U channel that also functions as a magnetic shield. The magnetic flux concentrator device 3 may be deployed in pickups with U channel shields arranged around the outside of the associated coil and should not be construed as any type of a magnetic shield in itself, since there is no shielding required or effective at the core of the coil. U channel shields are sometimes present in pickups to act as a barrier to electromagnetic radiation in the form of 60 Hz mains hum as well as to conduct magnetism but these are always on the outside of the coil since that is the most effective placement for a shield to prevent such radiation from penetrating the coil.

FIG. 3 is the same pickup as is illustrated in FIG. 2 (but is not shown in exploded perspective) with magnetic flux concentrator device 3 present.

Figure 4:
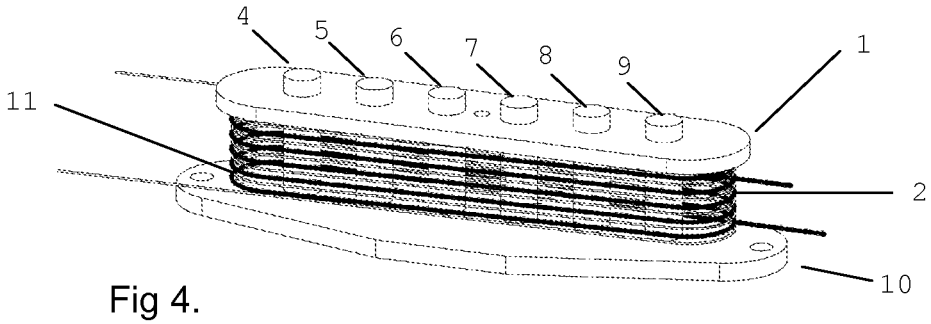
FIG. 4 shows the same pickup as FIG. 1 with the addition of the inventive magnetic flux concentrator device in the form of a second coil wound with ferromagnetic wire. The second coil of wire is magnetically attractive and therefore attracts the magnetic energy emanating from the ends of the magnets and concentrates it into the coil space.

FIG. 4 illustrates a second embodiment of the present invention and is similar to the pickup of FIGS. 2 and 3 but, instead of a sheet metal magnetic flux concentrator device 3 wrapped around the set of rod magnets, there is a coil 11 of magnetic wire such as steel wire integrated into the coil of insulated copper wire by a coil winding technique known as bifilar winding. Bifilar winding is where two separate filaments of wire are wound simultaneously and concurrently into the same singular coil space and requires coil winding machinery and equipment specially adapted for the purpose. The presence of the steel filament has the same effect as a steel sheet metal magnetic flux concentrator device. The two coils need not be electrically connected but may be connected for reasons of convenience or efficiency. The steel wire filament may be copper clad to protect against corrosion and may be insulated to prevent undesirable short circuits.

Another possible embodiment that may also be dually represented in FIG. 4 is two separate coils wound one beneath and before the other. The first coil is wound with steel wire and functions as a magnetic flux concentrator device by substituting and occupying the space of a sheet metal magnetic flux concentrator device in intimate proximity to the core as depicted in FIGS. 2 and 3. The steel wire coil 11 may not necessarily have electrical connections since its main function is to attract magnetic energy into the space occupied by the coil. Again this results in a rise in inductance caused by a greater concentration of magnetic energy with an accompanied increased efficiency of the coil.

Figure 5:
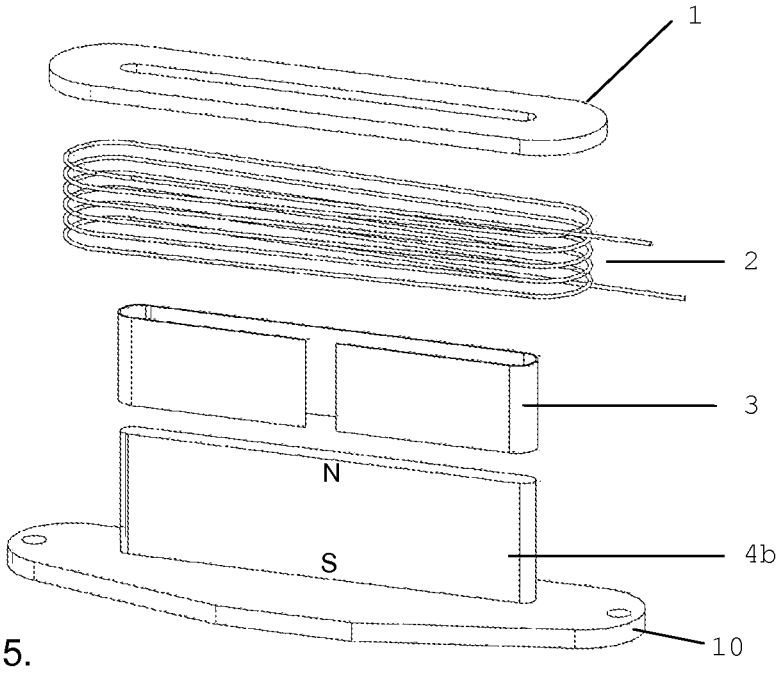
FIG. 5 is an exploded perspective showing a single coil or single pole pickup that has a blade pole. The blade can be a permanent magnet or it can be ferromagnetic material such as steel.
Figure 6:
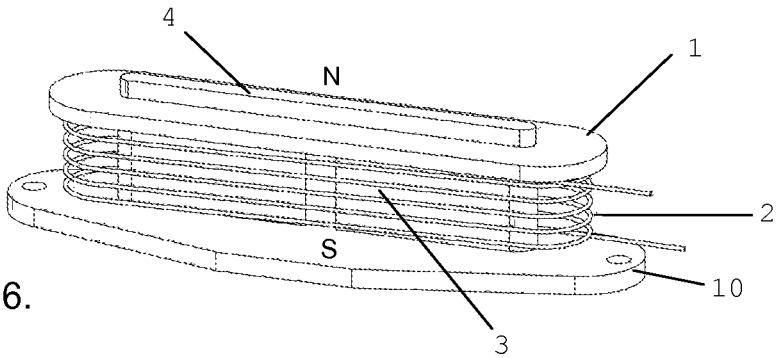
FIG. 6 shows the same pickup as FIG. 5, including the inventive magnetic flux concentrator device. The magnetic flux concentrator device is magnetic and therefore attracts the magnetic energy emanating from the ends of the blade pole and concentrates it into the coil space.

FIGS. 5 and 6 show one possible embodiment, respectively in exploded and assembled perspective, with a non-segmented bar 4*b*. In this embodiment, Bar 4*b* is a permanent magnet (replacing the multiple rod magnets of the prior embodiment) serving as the core of the string sensing coil. This bar magnet is magnetized vertically across its width with one of the magnetic poles being presented to the instruments strings. Upper flange 1 and bottom flange 10 support the bar magnet and form the bobbin in which the electrical coil 2 is wound. Magnetic flux concentrator device 3 is provided as a flat strip of steel or other magnetic material. Magnetic flux concentrator device 3 is disposed around or along the sides the bar magnet.

In a second embodiment of a pickup of the type illustrated in FIGS. 5 and 6, the ferromagnetic blade or bar 4*b* may be either a segmented or non-segmented ferromagnetic non-permanent magnetic core of the coil and can typically be comprised of steel. By "segmented" is meant a number of magnetic components as in the case of a plurality of non-permanently magnetic ferromagnetic poles which may or may not be adjustable for variable protrusion from the top face of the pickup. This steel bar, or steel pole piece segments are magnetized by an associated permanent magnet disposed proximate and adjacent to the bar. Embodiments of the invention also relate to these types of pickups since the inclusion of the magnetic flux concentrator device 3 around the steel blade or steel pole pieces increases efficiency in the same manner it increases efficiency for pickups having rod magnet cores, more so than simply making the blade thicker.

FIG. 7 depicts a side-by-side hum canceling pickup commonly known as a humbucker. The construction has been simplified in this drawing for improved clarity. In this simplified form it is comprised of upper bobbin flanges 24 and 27, a baseplate 26, a permanent bar magnet 25 which is magnetized across its width to magnetize ferrous pole pieces 12, 13, 14, 15, 16, 17 with a South pole polarity and poles 18, 19, 20, 21, 22 and 23 with North pole polarity. There are two coils 29 and 30 wound with insulated copper wire or insulated or non insulated steel wire or a combination of copper and steel wire. At least 1 of the coils of each bobbin are connected together, and the output fed to an amplifier and loudspeaker.

FIG. 8 shows the same side by side humbucking pickup with the addition of the magnetic flux concentrator device 31 in embodiments of the invention, which may be present in either or both coils. In this example, the magnetic flux concentrator device 31 is present in the form of a flat iron strip wrapped around the pole pieces at the core of the coils.

Disposing the magnetic flux concentrator device in association with the coils of humbucker pickups also causes an increase in efficiency similar to other types of pickups previously described. While this invention has been described with reference to one or more embodiments, it will be understood by those skilled in the art that various changes may be made and equivalents may be substituted for elements thereof without departing from the scope of the invention and claims. For example, the inventive core strip or other inventive flux concentrators may be used with different kinds of pickups, such as single coils with permanent magnet cores in the string sensor, single coil with steel core and bar magnets, side-by-side dual coil humbuckers, with permanent magnet core and steel core with bar magnets, vertical humbuckers (permanent magnet core or steel cores and bar magnets), pickups that have steel U channels around a string sensor, and hum sensors (not integrated into a pickup).

In addition, many modifications may be made to adapt a particular situation or material to the teachings of the invention without departing from the essential scope thereof. Therefore, it is intended that the invention not be limited to the particular embodiments disclosed as the best mode contemplated for executing this invention.

While an illustrative embodiment (s) of the invention has been described, it is noted that various modifications will be apparent to those of ordinary skill in the art in view of the above description and drawings. Such modifications are within the scope of the invention which is limited and defined only by the following claims.

What is claimed is:

1. An electromagnetic pickup adapted to be secured to a stringed musical instrument of the type having a plurality of strings of ferromagnetic composition, wherein said strings are tensioned to vibrate with a vibration corresponding to musical notes in response to mechanical stimulation, said electromagnetic pickup comprising at least one magnetized core, said magnetized core having a length and a width, said magnetized core creating a magnetic field, an electrically conductive member configured into at least one coil extending around said magnetized core, and a ferromagnetic material positioned on at least one side of said length of said magnetized core and radially inwardly of at least a portion of said electrically conductive member, said ferromagnetic material being positioned outside of said magnetized core, said electromagnetic pickup mounted proximate said strings in such a manner that said magnetic field of said pickup extends to said strings causing variations in said magnetic field and generating in said coil an output electrical signal in response to said vibration of said strings.

2. An electromagnetic pickup as in claim 1, wherein said electrically conductive member comprises insulated copper wire and said ferromagnetic material comprises at least one ferromagnetic member, said ferromagnetic material having a length and a width and a thickness much smaller than said length and width.

3. An electromagnetic pickup as in claim 1, wherein said electrically conductive member comprises insulated copper wire and said ferromagnetic material comprises ferromagnetic wire.

4. An electromagnetic pickup as in claim 1, wherein said magnetized core comprises at least one permanent magnet and said ferromagnetic material comprises a plurality of segments to minimize eddy current effects.

5. An electromagnetic pickup as in claim 1, wherein said magnetized core comprises at least one ferromagnetic member that is not a permanent magnet and an associated permanent magnet, said associated permanent magnet being disposed adjacent to said ferromagnetic member that is not a permanent magnet.

6. An electromagnetic pickup as in claim 1 wherein said electrically conductive member comprises insulated copper wire and said ferromagnetic material comprises steel wire, said steel wire and said copper wire forming a coil of copper windings interspersed with steel windings.

7. A stringed musical instrument incorporating the pickup of claim 1, wherein said electrically conductive member comprises an insulated copper wire coil and said ferromagnetic material comprises at least one strip of ferromagnetic material having a length and a width and a thickness much smaller than said length and width, said strip being placed with its width extending in a direction roughly parallel to the coil axis and extending around said magnetized core.

8. An electromagnetic pickup as in claim 1, wherein said ferromagnetic material is steel wire and said electrically conductive member is copper cladding disposed over said steel wire, said copper cladding and said steel wire together forming an electrically conductive ferromagnetic member disposed around said magnetized core.

9. A stringed musical instrument comprising an instrument body, a plurality of strings of ferromagnetic composition mounted on said instrument body, and an electromagnetic pickup adapted to be secured to said stringed musical instrument, wherein said strings are tensioned to vibrate with a vibration corresponding to musical notes in response to mechanical stimulation, said electromagnetic pickup comprising magnetized core, said magnetized core having a length and a width, said magnetized core creating a magnetic field, an electrically conductive member configured into at least one coil extending around said magnetized core, and a ferromagnetic material positioned on at least one side of said length of said magnetized core and radially inwardly of at least a portion of said electrically conductive member, said ferromagnetic material being positioned outside of said magnetized core, said electromagnetic pickup mounted proximate said strings in such a manner that said magnetic field of said pickup extends through said strings causing variations in said magnetic field and generating in said coil an output electrical signal in response to said vibration of said strings, wherein said electrically conductive member comprises an insulated copper wire coil and said ferromagnetic material comprises a coil of ferromagnetic wire, said coil of ferromagnetic wire being wound co-planar and co-axial with windings of said copper wire coil.

10. An electromagnetic pickup adapted to be secured to a stringed musical instrument, such as guitar or bass or the like, of the type having a plurality of magnetic strings of ferromagnetic composition such as steel tensioned to provide musical notes under mechanical stimulation such as picking, said electromagnetic pickup comprising at least one magnetized core having a length and a width, an electrically conductive material wound into at least one coil around said magnetized core, and a ferromagnetic material such as iron, nickel, cobalt and alloys thereof disposed as sheet steel or steel wire positioned on at least one side of said length and internally of at least a portion of said electrically conductive material, said electrically conductive material comprising a first conductive wire, and said electrically conductive material forming at least one pickup coil winding, said ferromagnetic material being positioned outside of said magnetized core and said electromagnetic pickup mounted proximate said strings in such a manner that magnetic field of said pickup extends to said strings thereby generating an electrical output signal analogous to said musical notes in response to vibration of said strings.

11. An electromagnetic pickup as in claim 10, further comprising a second conductive wire wound around a second ferromagnetic core to form a hum canceling pair of coils, said hum canceling pair of coils being connected in a manner to cancel at least a portion of electrical noise induced in said pickup winding by electromagnetic radiation.

12. An electromagnetic pickup as in claim 11, wherein said hum canceling pair of coils are positioned horizontally with their axes perpendicularly beside each other.

13. An electromagnetic pickup as in claim 12, wherein the axis of hum canceling pair of coils are positioned to extend coaxially along a common line.

* * * * *